US011622622B2

(12) United States Patent
Bergsma

(10) Patent No.: US 11,622,622 B2
(45) Date of Patent: Apr. 11, 2023

(54) MODULAR TABLE

(71) Applicant: MiEN Company, Grand Rapids, MI (US)

(72) Inventor: Remco Bergsma, Grand Rapids, MI (US)

( * ) Notice: Subject to any disclaimer, the term of this patent is extended or adjusted under 35 U.S.C. 154(b) by 141 days.

(21) Appl. No.: 17/149,012

(22) Filed: Jan. 14, 2021

(65) Prior Publication Data

US 2021/0212451 A1 Jul. 15, 2021

Related U.S. Application Data

(60) Provisional application No. 62/961,115, filed on Jan. 14, 2020.

(51) Int. Cl.
*A47B 13/02* (2006.01)

(52) U.S. Cl.
CPC ..... *A47B 13/02* (2013.01); *A47B 2200/0012* (2013.01); *A47B 2200/12* (2013.01)

(58) Field of Classification Search
CPC ... A47B 13/02; A47B 13/083; A47B 2200/12; A47B 2200/0012; A47G 11/003; A47G 11/004
See application file for complete search history.

(56) References Cited

U.S. PATENT DOCUMENTS

| | | | | | |
|---|---|---|---|---|---|
| 1,664,292 | A * | 3/1928 | Gloekler | A47B 13/083 52/782.2 |
| 11,140,978 | B1 * | 10/2021 | Baker | A47B 96/20 |
| 2010/0269738 | A1 * | 10/2010 | Collins | A47B 13/06 248/150 |
| 2021/0353075 | A1 * | 11/2021 | Ward | A47F 9/04 |

FOREIGN PATENT DOCUMENTS

| | | | | |
|---|---|---|---|---|
| CN | 205093820 | U * | 3/2016 | A47B 13/08 |
| EP | 1787546 | A1 * | 5/2007 | A47B 13/02 |
| EP | 1787546 | A1 | 5/2007 | |
| KR | 100951043 | B1 | 4/2010 | |
| KR | 100981009 | B1 | 9/2010 | |
| KR | 20100010240 | U | 10/2010 | |
| WO | 2018032064 | A1 | 2/2018 | |

* cited by examiner

*Primary Examiner* — Matthew W Ing
(74) *Attorney, Agent, or Firm* — Oppenhuizen Law PLC; David L. Oppenhuizen

(57) ABSTRACT

A table including a frame having a leg portion, a tabletop support portion, and a tabletop positioned on the tabletop support portion. The tabletop has one pair of opposed side structures, and each of the opposed structures has a first bent portion extending downward. Also, each of the opposed side structures is further bent greater than 90 degrees from the orientation of the tabletop so as to surround and partially envelop the tabletop support portion. The table can also include a side panel that is stowable in the leg portion. The side panel can selectively be removed from the leg portion and placed onto the tabletop by a user to function as a temporary partition.

8 Claims, 5 Drawing Sheets

MODULAR TABLE

CROSS REFERENCE TO RELATED APPLICATION

This application claims the benefit of U.S. Provisional Application 62/961,115, which was filed on Jan. 14, 2020, the disclosure of which is hereby incorporated by reference.

BACKGROUND OF THE INVENTION

1. Field of the Invention

The present disclosure pertains to a table. More particularly, the present disclosure pertains to a table having a unique tabletop and removable side panels.

2. Description of the Prior Art

A table used for reading or learning, generally, includes a tabletop and one or more legs extending downwardly from the tabletop. Such a table is effective in the group learning structure, but when intensive learning is needed, the user's concentration can be greatly reduced due to the cluttered and distracting atmosphere of the surroundings. One way to facilitate intensive learning is to utilize tables having one or more partitions, such as a table used in a library or a reading room. However, the use of such tables with permanent partitions is limited. Therefore, a table is needed that can facilitate both group learning as well as intensive learning.

SUMMARY OF THE INVENTION

According to an aspect of the disclosure a table is disclosed. The table includes a frame having a leg portion and a tabletop support portion, and a tabletop positioned on the tabletop support portion. The tabletop has one pair of opposed side structures, and each of the opposed structures has a first bent portion extending downward. Also, each of the opposed side structures is further bent greater than 90 degrees from the orientation of the tabletop.

Optionally the tabletop comprises a metal material, and may further optionally comprise a ferromagnetic material.

Optionally at least one of the opposed side structures, or each of the opposed side structures, includes the first bent portion and a first straight portion. The first bent portion may be a delineated line of curvature, or it can be a curved section.

Furthermore, optionally each of the opposed side structures can include a second bent portion and a second straight portion, the second bent portion being positioned between the first straight portion and the second straight portion.

Optionally, the tabletop partially envelopes the tabletop support portion.

Optionally, the table includes a side panel that is removably secured to the leg portion. The optional side panel can include a plurality of magnets and the leg support portion comprises a ferromagnetic material such that the magnets removably secure the side panel to the leg portion.

The optional side panel can be removably secured to the leg portion, wherein the side panel includes a plurality of magnets and the leg portion comprises a ferromagnetic material such that the magnets removably secure the side panel to the leg portion, and wherein the side panel is configured to be removed from the leg portion and removably secured to and atop the tabletop.

According to another aspect of the disclosure, the table includes a frame having a leg portion and a tabletop support portion, and a tabletop positioned on the tabletop support portion. The table further includes a side panel that is removably secured to the leg portion.

For a more complete understanding of the present invention, reference is made to the following detailed description and accompanying drawings. In the drawings, like reference characters refer to like parts throughout the views in which:

DETAILED DESCRIPTION OF A PREFERRED EMBODIMENT

Figure 1:
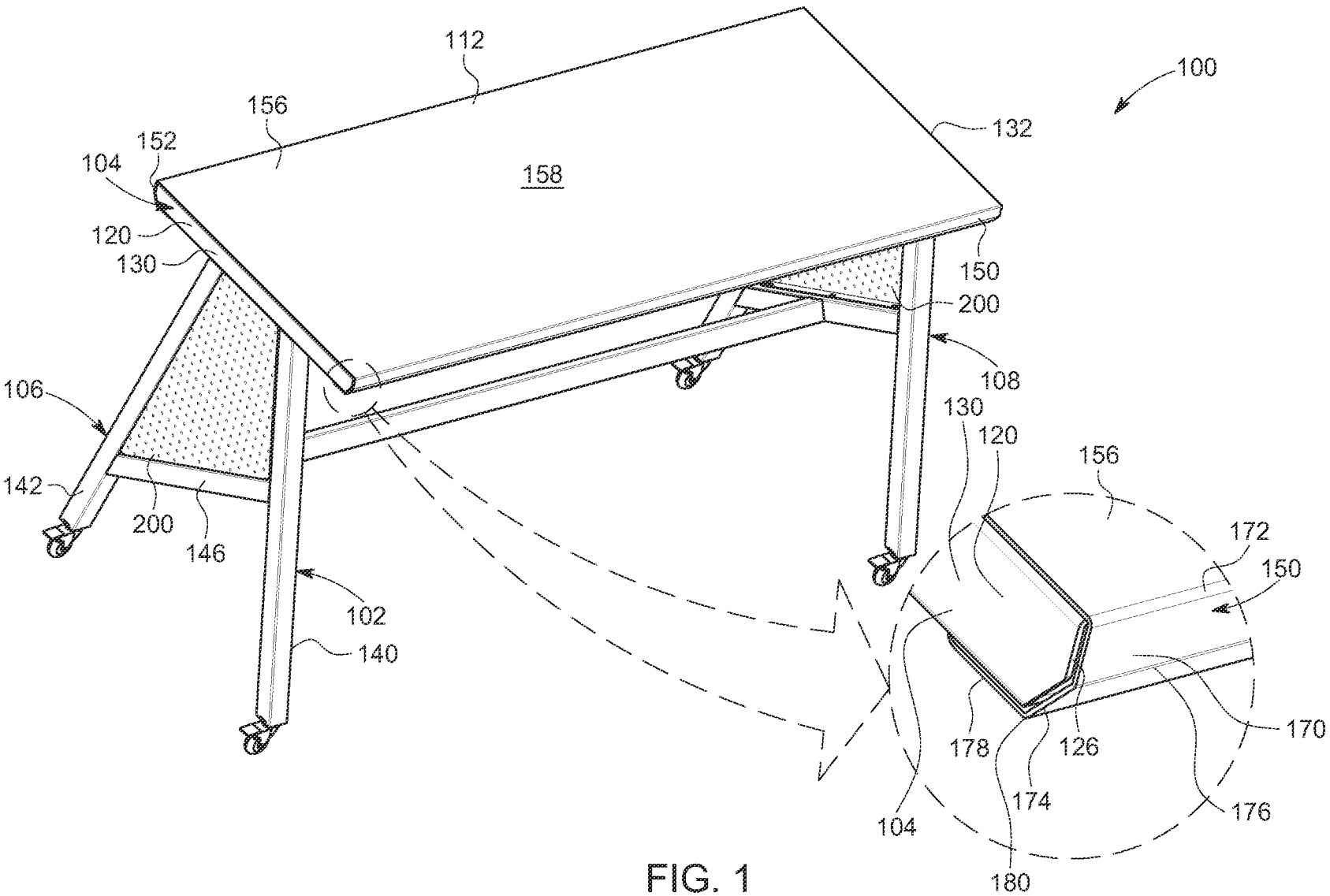
FIG. 1 illustrates a top perspective view of a table having a side panel disposed in a stowed position, in accordance with an embodiment of the disclosure.
Figure 2:
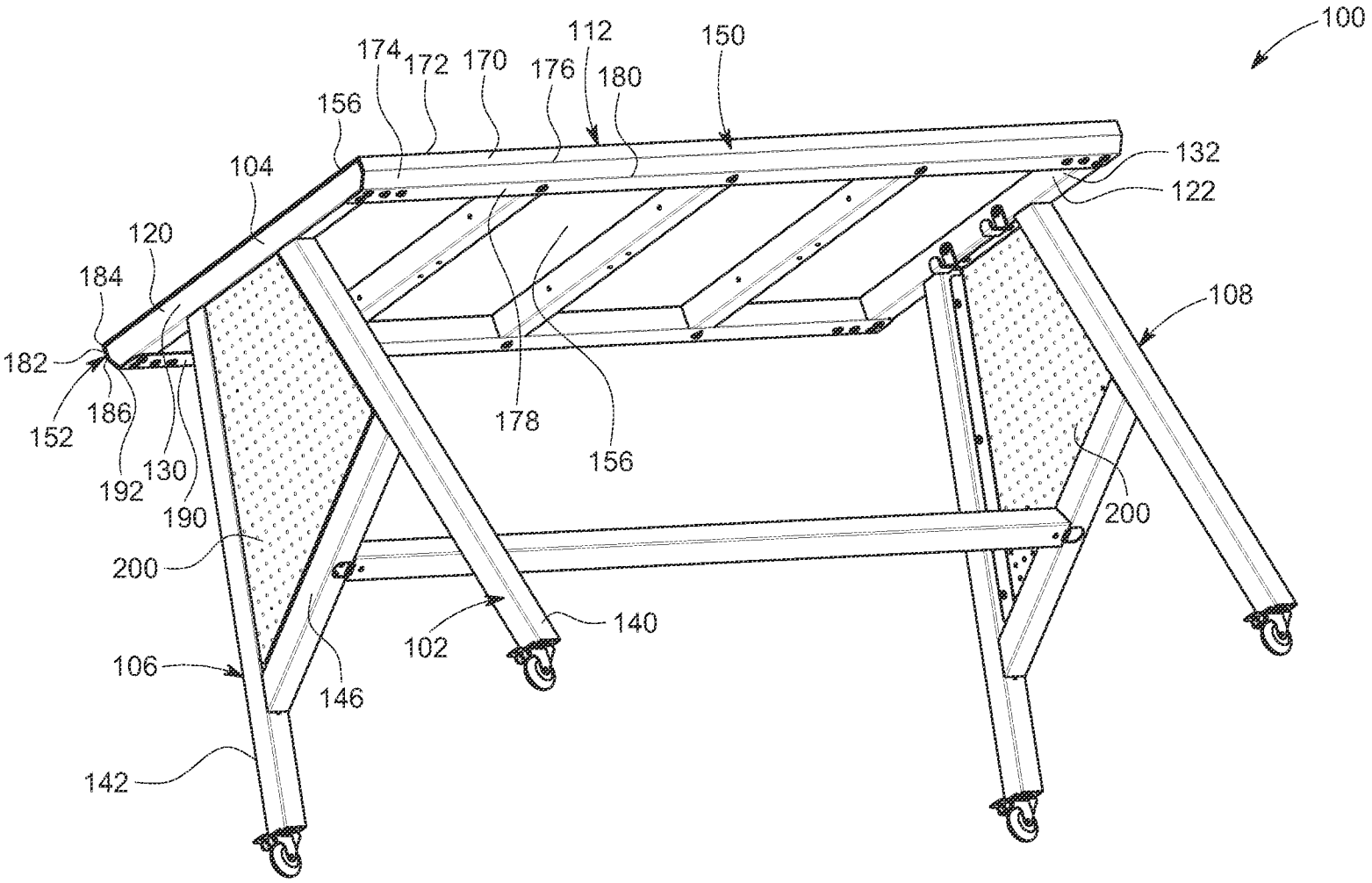
FIG. 2 illustrates a bottom perspective view of the table of FIG. 1, in accordance with an embodiment of the disclosure.

Referring to FIGS. 1, 2, 3 and 5, an exemplary table 100 is shown. The table 100 includes a frame 102 having a tabletop support portion 104, and a pair of leg portions, for example, a first leg portion 106 and a second leg portion 108. The first leg portion 106 and the second leg portion 108 extend substantially downwardly from the tabletop support portion 104 and are adapted to permit the table to stand on a surface, such as the ground or a floor surface. As shown, the tabletop support portion 104 may extend substantially horizontally and parallel to the surface, while the first leg portion 106 and the second leg portion 108 may be disposed at an inclination to the surface, and hence to the tabletop support portion 104.

Figure 3:
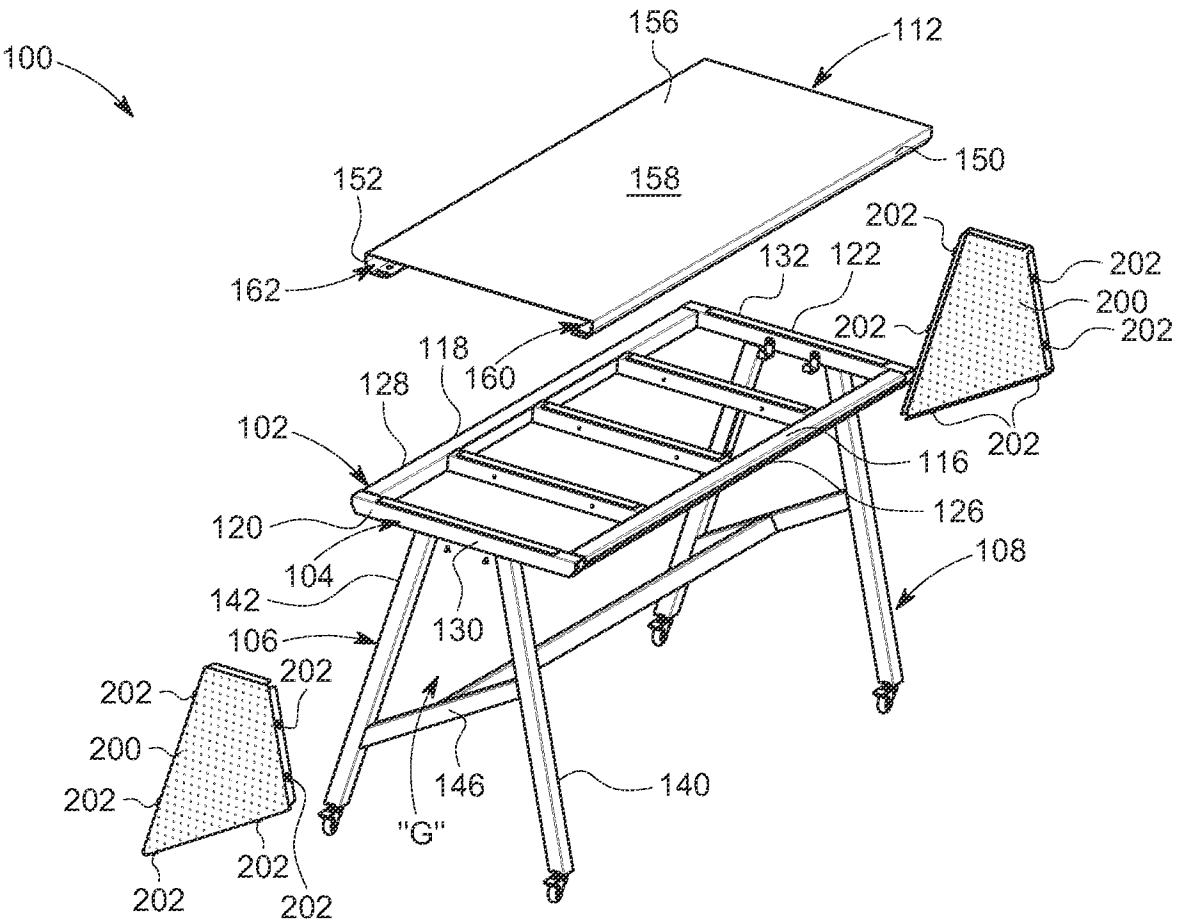
FIG. 3 illustrates an exploded view of the table of FIG. 1, in accordance with an embodiment of the disclosure.

As shown best in FIG. 3, the tabletop support portion 104 is adapted to support a tabletop 112 of the table 100 and may include a pair of longitudinal truss members, for example, a first longitudinal truss member 116 and a second longitudinal truss member 118 disposed spaced apart from the first longitudinal truss member 116. The tabletop support portion 104 also includes a pair of lateral truss members which extend between the pair of longitudinal truss members 116, 118 and are connected to each of the pair of longitudinal truss members 116, 118. The pair of lateral truss members can include, for example, a first lateral truss member 120, and a second lateral truss member 122 which is disposed spaced apart from the first lateral truss member 120. The first longitudinal truss member 116 may define a first longitudinal side 126 (hereinafter referred to as a first side 126) of the tabletop support portion 104, while the second longitudinal truss member 118 may define a second longitudinal side 128 (hereinafter referred to as a second side 128) of the tabletop support portion 104. Similarly, the first lateral truss member 120 may define a first lateral side 130 (hereinafter referred to as a third side 130) of the tabletop support portion 104, while the second lateral truss member 122 may define a second lateral side 132 (hereinafter referred to as a fourth side 132) of the tabletop support portion 104. Accordingly, the tabletop support portion 104 may include a substantially rectangular structure for supporting the tabletop 112. Although a rectangular tabletop support portion 104 is shown and contemplated, it may be envisioned that the tabletop support portion 104 may be any other shape, including but not limited to, a circular shape, an elliptical shape, a square shape, a polygonal shape, or any other suitable shape known in the art.

Furthermore, the first leg portion 106 is disposed proximate to the third side 130 and may extend substantially downwardly toward the floor surface from the third side 130, while the second leg portion 108 is disposed proximate to the fourth side 132 and may extend substantially downwardly toward the floor surface from the fourth side 132. It may be appreciated that the second leg portion 108 may be similar in construction, structure, assembly, and function to the first leg portion 106, and for the sake of clarity and brevity, only the first leg portion 106 (hereinafter referred to as the leg portion 106) is discussed and the details and description of the first leg portion 106 will apply equally to the second leg portion 108. As shown, the leg portion 106 may include a first leg 140, a second leg 142 located at a distance from the second leg 142, and a connecting member 146 extending from the first leg 140 to the second leg 142 and connected/attached to the first leg 140 and the second leg 142. In an implementation, the connecting member 146 is disposed spaced apart and below from the first lateral truss member 120 and thereby defines a gap "G" therebetween. Preferably, the connecting member 146 extends from a medial portion of the first leg 140 to a medial portion of the second leg 142. Optionally, the connecting member 146 may be omitted.

Figure 4:
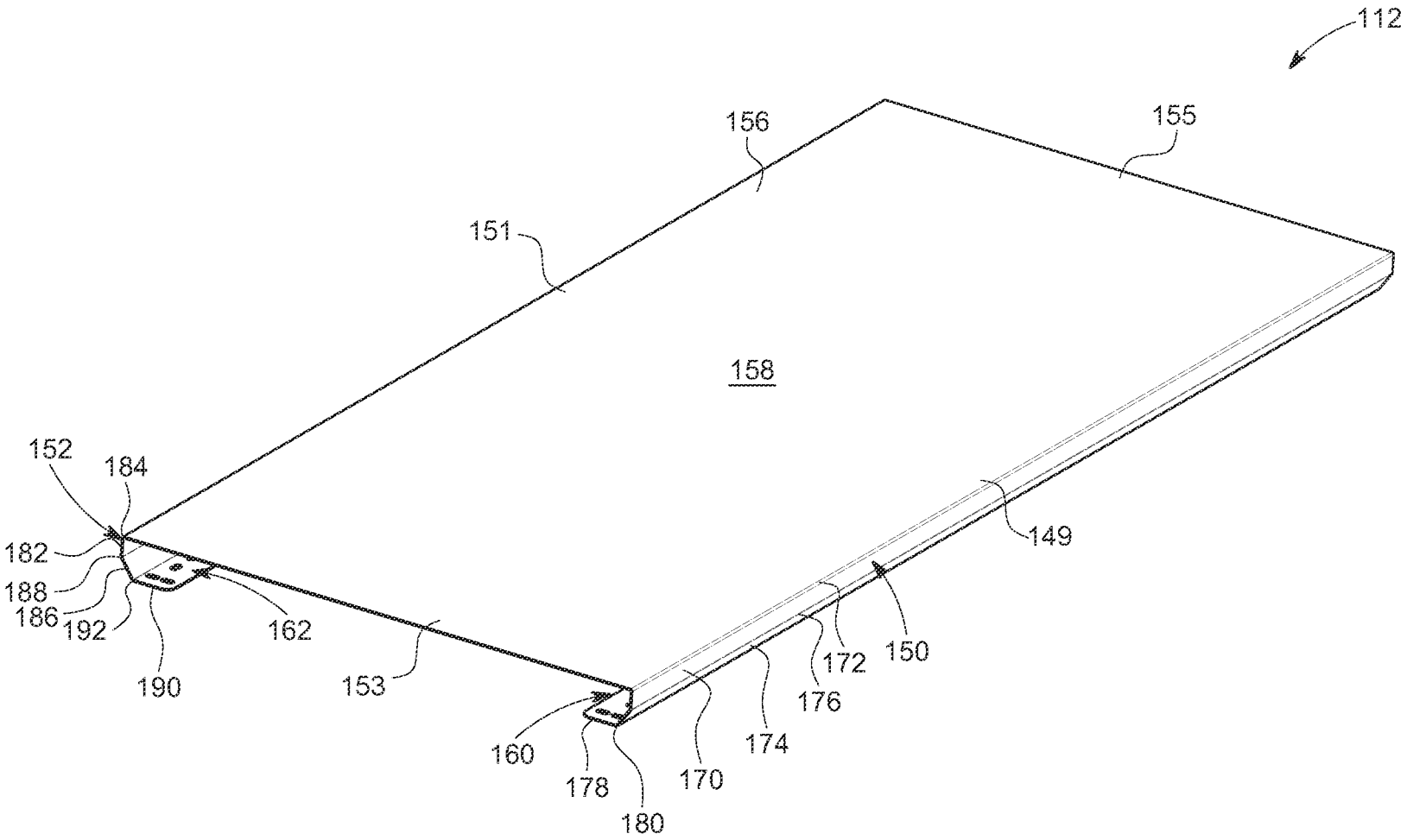
FIG. 4 illustrates a perspective view of a tabletop of the table of FIG. 1, in accordance with an embodiment.
Figure 5:
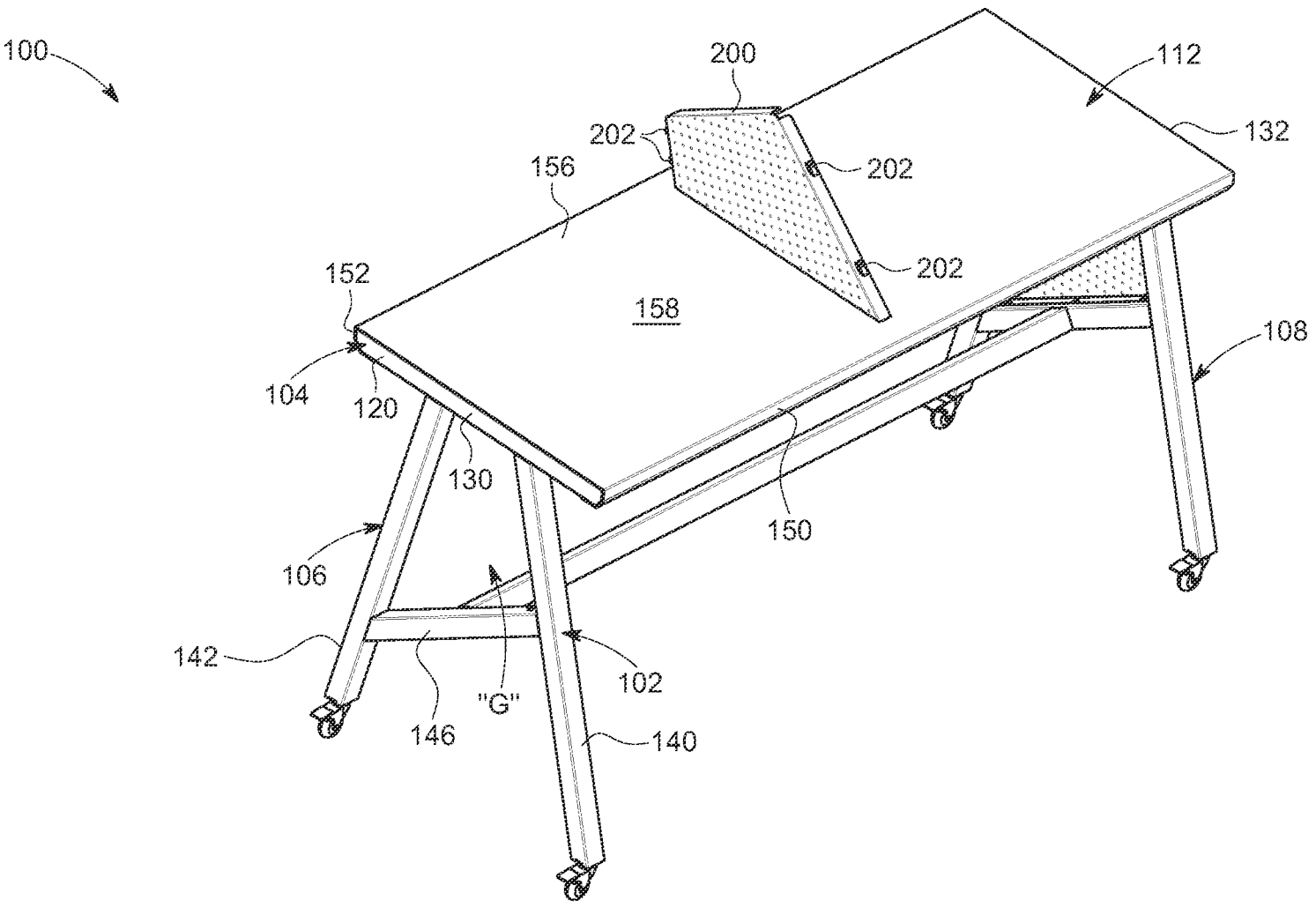
FIG. 5 illustrates a top perspective view of table having the side panel disposed in an in-use position, in accordance with an embodiment of the disclosure.

Referring to FIGS. 3 and 4, the tabletop 112 includes a first longitudinal side 149 having a first side structure 150 extending along the first side 126 (i.e., the first longitudinal truss member 116) of the tabletop support portion 104, and a second longitudinal side 151 having a second side structure 152 disposed spaced apart and substantially parallel to the first side structure 150. As illustrated, the second side structure 152 may extend along the second side 128 (i.e. the second longitudinal truss member 118) of the tabletop support portion 104. The tabletop 112 also includes a first transverse side 153 and a second transverse side 155, the second transverse side 155 being positioned on the tabletop 112 opposite of the first transverse side 153. Furthermore, the tabletop 112 includes a flat structure 156 extending between the first longitudinal side 149, the second longitudinal side 151, the first transverse side 153, and the second transverse side 155, thereby providing a top surface 158 of the table 100. The first side structure 150 and the second structure 152 may extend substantially downwardly (toward the floor surface) from the flat structure 156. Preferably the first side structure 150 and the second side structure 152 each bend downwardly from the plane of the tabletop 112 at an angle of greater than 90 degrees to each define a first elongated cavity 160 (best shown in FIG. 4) and a second elongated cavity 162 (best shown in FIG. 4) to facilitate a removable attachment of the tabletop 112 with the tabletop support portion 104. Optionally, the first side structure 150 and the second side structure 152 can be bent up to 180 degrees, such as shown in FIGS. 1 and 4, such that the cavity 162 is defined on three sides by the first side structure 150 or the second side structure 152. Accordingly, when the first side structure 150 and the second side structure 152 are bent 180 degrees then a portion of the first side structure 150 and a portion of the second side structure 154 are angled generally back toward the flat structure 156, and are additionally oriented on a plane parallel to the flat structure 156. The downwardly bent first side structure 150 and the second structure 152 can have bent portions formed from a series of linear bends and straight sections (such as shown throughout the drawings), the bent portions can be more gently curved having a relatively larger radius of curvature (not shown), or any other suitable type of bent structure. And as shown in the drawings, the first transverse side 153 and the second transverse side 155 preferably are free of any downward-extending portion to facilitate the tabletop 112 to be slid onto or off of the tabletop support portion 104.

The first elongated cavity 160 is adapted to receive, at least partly, the first longitudinal truss member 116, while the second elongated cavity 162 is adapted to receive, at least partly, the second longitudinal truss member 118. To securely attach the tabletop 112 with the tabletop support portion 104, the first side structure 150 is positioned within the first elongated cavity 160 and attached to the first longitudinal truss member 116, while the second side structure 152 is positioned within the second elongated cavity 162 and attached to the second longitudinal truss member 118. Accordingly, the tabletop 112 partially envelops the table support portion 104, and may be installed onto (or removed from) the table support portion 104 by sliding the first longitudinal truss member 116 and the second longitudinal truss member 118 into the first elongated cavity 160 and the second elongated cavity 162, respectively. Furthermore, the first side structure 150 and the second side structure 152 may be attached to the tabletop support portion 104 using a plurality of fasteners, such as screws, bolts, or the like. Additionally, or optionally, the flat structure 156 may also be attached to the first lateral truss member 120 and the second lateral truss member 122 using a plurality of fasteners, such as screws, bolts, or the like.

Moreover, the first side structure 150 of the tabletop 112 can optionally include a first straight portion 170, and a first bent portion 172 connecting the flat structure 156 with the first straight portion 170. In an assembly of the tabletop 112 with the tabletop support portion 104, the first bent portion 172 is bent substantially downwardly from the flat structure 156, while the first straight portion 170 may extend downwardly from the first bent portion 172. Preferably, the first straight portion 170 may extend vertically downwardly from the first bent portion 172. The first side structure 150 may also include a second straight portion 174 and a second bent portion 176 disposed between the first straight portion 170 and the second straight portion 174 and connecting the first straight portion 170 to the second straight portion 174. Preferably, the second straight portion 174 may be disposed at an inclination to the first straight portion 170 and may extend generally towards the second side structure 152 from the first straight portion 170. As shown, the second straight portion 174 may extend downwardly from the first straight portion 170. In an implementation, an angle between the first straight portion 170 and the second straight portion 174 may be an obtuse angle that may be greater than 120 degrees.

Additionally, or optionally, the first side structure 150 may include a third straight portion 178 and a third bent portion 180. The third bent portion 180 is positioned between and connects the second straight portion 174 and the third straight portion 178. As shown, the third straight portion 178 may be disposed opposite to the flat structure 156 and may be substantially parallel to the flat structure 156. In this manner, the first side structure 150 defines the first elongated cavity 160 to slidably receive, at least partly, the first longitudinal truss member 116. Accordingly, when assembled with the tabletop support portion 104, the third straight portion 178 may abut a bottom surface of the tabletop support portion 104, while the flat structure 156 may abut a top surface of the tabletop support portion 104. Accordingly, it is shown that the first side structure partially surrounds and envelops the tabletop support portion 104. Furthermore, an angle between the third straight portion 178 and the second straight portion 174 may be an obtuse angle such that the third straight portion 178 extends generally toward the second side structure 152 from the third bent portion 180 (or relative to the second straight portion 174).

Similar to the first side structure 150, the second side structure 152 includes a first straight portion 182 extending substantially downwardly from the flat structure 156, and a first bent portion 184 between the flat structure 156 and the first straight portion 182. The first bent portion 184 is angled downwardly from the flat structure 156. Also, the second side structure 152 may include a second straight portion 186 extending at an inclination relative to the first straight portion 182, and a second bent portion 188 extending between the first straight portion 182 and the second straight portion 186. The second straight portion 186 extends downwardly and towards the first side structure 150 relative to the second bent portion 188, and hence the first straight portion 182. Also, the second straight portion 186 may be disposed at an obtuse angle relative to the first straight portion 182. Additionally, or optionally, the second side structure 152 may include a third straight portion 190 and a third bent portion 192 positioned between the second straight portion 186 and the third straight portion 190. As shown, the third straight portion 190 may be disposed opposite to the flat structure 156. Thus, the third straight portion 190 may be disposed spaced apart from the flat structure 156, and is positioned substantially parallel to the flat structure 156. Also, the third straight portion 190 may extend toward the first side structure 150 from the third bent portion 192, and hence relative to the second straight portion 186. The resulting angle between the third straight portion 190 and the second straight portion 186 may be an obtuse angle. In this manner, the second side structure 152 defines the second elongated cavity 162 to slidably receive, at least partly, the second longitudinal truss member 118. Accordingly, when assembled with the tabletop support portion 104, the third straight portion 190 may abut a bottom surface of the tabletop support portion 104, while the flat structure 156 may abut a top surface of the tabletop support portion 104. Accordingly, it is shown that the second side structure 152 partially surrounds and envelops the tabletop support portion 104.

Furthermore, the tabletop 112 is assembled with the tabletop support portion 104 by, respectively, aligning the first elongated cavity 160 and the second elongated cavity 162 with the first longitudinal truss member 116 and second longitudinal truss member 118, respectively, and then sliding the tabletop 112 relative to the tabletop support portion 104 such that the first longitudinal truss member 116 is received, at least partly, inside the first elongated cavity 160, while the second longitudinal truss member 118 is received, at least partly, inside the second elongated cavity 162. Moreover, the tabletop 112 is preferably made of a metal material, for example, steel or any suitable material adapted to interact with a magnetic field. Preferably, the tabletop 112 is made of a ferromagnetic material.

Referring again to FIGS. 1, 2, 3 and 5, the table 100 includes a side panel 200 removably attached to the frame 102 and adapted to be disposed within the gap "G" and removably coupled to the leg portion 106 in a stowed position (shown in FIGS. 1 and 2). In another configuration, the side panel 200 can be disposed on the tabletop 112 and coupled to the flat structure 156 in an in-use position (shown in FIG. 5). Preferably, the side panel 200 is a polygonal structure and is magnetically coupled to the frame 102 (i.e. the leg portion 106) in the stowed position. For magnetically coupling the side panel 200 with the leg portion 106, a plurality of magnets 202 (best shown in FIG. 3) may be attached to one or more edges of the side panel 200. In an implementation, the plurality of magnets 202 may be secured to the side panel 200 using one or more fasteners, such as screws, adhesives, and so forth. In some other implementations, the side panel 200 may include a metal material, such as, steel or any other suitable material adapted to interact with a magnetic field. Preferably the side panel 200 may include a ferromagnetic material. In such a case, the plurality of magnets 202 are magnetically attached to both the frame 102 (i.e., the leg portion 106) and the side panel 200, and thereby facilitate the magnetic coupling of the side panel 200 with the frame 102.

Furthermore, in the in-use position, the side panel 200 is disposed on the flat structure 156 and coupled to the top surface 158 such that the side panel 200 extends upwardly from the flat structure 156 and partitions the flat structure 156. In an embodiment, the side panel 200 is magnetically coupled to the flat structure 156 using the plurality of magnets 202. The magnetic coupling of the side panel 200 with the leg portion 106 and tabletop 112 provides an easy and quick removal of the side panel 200 from the gap "G" and positioning and securing the side panel 202 on the tabletop 112. Therefore, the side panel 200 may act as a privacy screen which can quickly and easily be stowed in the gap "G," or placed onto the tabletop 112 as a partition, as desired by the user. Furthermore, the side panel 200 may include a plurality of holes, like a pegboard, to permit attachment of hang hooks and other objects for organization.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. A table comprising:

a frame having a leg portion and a tabletop support portion; and a tabletop positioned on the tabletop support portion, the tabletop having a top surface being surrounded by a first longitudinal side, a second longitudinal side, a first transverse side, and a second transverse side, the first longitudinal side and the second longitudinal side including one pair of opposed side structures, each of the opposed side structures having a first bent portion extending downward, a first straight portion, a second bent portion, and a second straight portion, the second bent portion being positioned between the first straight portion and the second straight portion, and each of the opposed side structures further being bent greater than 90 degrees to partially surround and envelop the tabletop support portion, and wherein the first transverse side and the second transverse side are free of any downward-extending portion thereby allowing the tabletop to be slid onto or off of the tabletop support portion.

2. The table of claim 1 wherein the tabletop comprises a metal material.

3. The table of claim 2 wherein the tabletop comprises a ferromagnetic material.

4. The table of claim 3 including a side panel that is removably secured to the leg portion, wherein the side panel includes a plurality of magnets and the leg portion comprises a ferromagnetic material such that the magnets removably secure the side panel to the leg portion, and wherein the side panel is configured to be removed from the leg portion and removably secured to and atop the tabletop.

5. The table of claim 1 further including a side panel that is removably secured to the leg portion.

6. The table of claim 5 wherein the side panel includes a plurality of magnets and the leg portion comprises a ferromagnetic material such that the magnets removably secure the side panel to the leg portion.

7. A table comprising:

a frame having a leg portion and a tabletop support portion; and a tabletop positioned on the tabletop support portion, the tabletop having a top surface being surrounded by a first longitudinal side, a second longitudinal side, a first transverse side, and a second transverse side, the first longitudinal side and the second longitudinal side including one pair of opposed side structures, each of the opposed side structures having a first bent portion extending downward from the top surface, a first straight portion extending from the first bent portion, a second bent portion extending from the first straight portion, a second straight portion extending from the second bent portion, a third bent portion extending from the second straight portion, and a third straight portion extending from the third bent portion, wherein the first bent portion, the second bent portion, and the third bent portion are collectively bent substantially 180 degrees such that the third bent portion is oriented parallel to the top surface.

8. A table comprising:

a frame having a leg portion and a tabletop support portion; and a tabletop positioned on the tabletop support portion, the tabletop having a top surface being surrounded by a first longitudinal side, a second longitudinal side, a first transverse side, and a second transverse side, the first longitudinal side and the second longitudinal side including one pair of opposed side structures, each of the opposed side structures having a first bent portion extending downward from the top surface, a first straight portion extending from the first bent portion, a second bent portion extending from the first straight portion, and a second straight portion extending from the second bent portion, wherein each of the opposed side structures are bent substantially 180 degrees such that a portion of each opposed side structure is oriented parallel to the top surface and defines a cavity for accepting the tabletop support portion.

* * * * *